US005282871A

United States Patent [19]

Yamane et al.

[11] Patent Number: 5,282,871

[45] Date of Patent: Feb. 1, 1994

[54] SPINNING LUBRICANT COMPOSITION FOR ACRYLIC FIBER

[75] Inventors: Koichi Yamane; Masayuki Abe, both of Wakayama; Masaki Itabashi, Chiba, all of Japan; Jose S. Comas, Barcelona, Spain

[73] Assignee: KAO Corporation, Tokyo, Japan

[21] Appl. No.: 569,974

[22] Filed: Aug. 20, 1990

[30] Foreign Application Priority Data

Sep. 7, 1989 [JP] Japan ..... 1-232085

[51] Int. Cl.[5] ..... D06M 15/00

[52] U.S. Cl. ..... 8/155.6; 252/8.6; 252/8.7; 252/8.75; 252/8.8; 427/393.1

[58] Field of Search ..... 8/115.6; 252/8.75, 8.6, 252/8.7, 8.8; 427/393.1

[56] References Cited

U.S. PATENT DOCUMENTS

| | | | |
|---|---|---|---|
| 3,434,874 | 3/1969 | Proffit, Jr. | 117/138.8 |
| 4,149,978 | 4/1979 | Goffinet | 8/115.6 |
| 4,343,616 | 8/1982 | Decker et al. | 8/115.6 |
| 4,382,111 | 5/1983 | Kuwayama et al. | 252/8.6 |
| 4,505,956 | 3/1985 | Yamamoto et al. | 427/393.1 |
| 4,767,669 | 8/1988 | Conklin et al. | 8/115.6 |
| 4,957,648 | 9/1990 | Yodice et al. | 252/8.6 |

FOREIGN PATENT DOCUMENTS

| | | |
|---|---|---|
| 0022239 | 1/1981 | European Pat. Off. . |
| 1055344 | 1/1967 | United Kingdom . |

*Primary Examiner*—Anthony Mc Farlane
*Attorney, Agent, or Firm*—Birch, Stewart, Kolasch & Birch

[57] ABSTRACT

A spinning lubricant composition for acrylic fiber, comprising:

(a) at least one wax having a melting point of 30 to 130 degree, selected from the group consisting of ester wax, paraffin wax, polyethylene wax and polyethylene oxide wax, and (b) at least one surfactant, being cationic or amphoteric, selected from the group consisting of surfactants having the respective formulae (1) to (5):

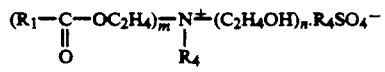

(1)

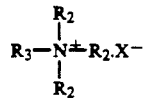

(2)

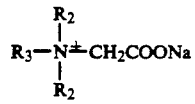

(3)

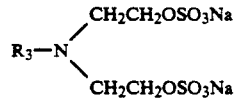

(4)

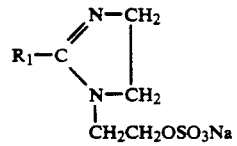

(5)

8 Claims, No Drawings

SPINNING LUBRICANT COMPOSITION FOR ACRYLIC FIBER

BACKGROUND OF THE INVENTION

1. Field of the Invention

This invention relates to a high-speed spinning lubricant for an acrylic fiber.

2. Description of Related Arts

Recently, efficiency improvements and the reduction of labor in the process of spinning synthetic fibers has been urged in the synthetic fiber spinning industry so as to reduce production costs.

Generally, if the speed of the spinning process is increased, the problems associated with the occurrence of fly and falling matters onto each part of a machine frame arise, due to lack of the static resistance and condensability or cohesiveness of the fiber. In addition the friction between yarns and various guide parts causes a deterioration in fiber quality, nonuniform dyeing, yarn breakage, and the like. Thus, a higher spinning speed involves various problems.

To solve these problems, a lubricant has been used in higher-speed spinning processes.

Generally, a lubricating agent, an antistatic agent and a condensing agent are added to the lubricant. Although wax has gained a wide application as the lubricating agent due to its good lubricating property, it suffers from the problem of poor condensing and antistatic properties. A cationic surfactant has also gained a wide application as the antistatic agent, but it is not free from the problem of a poor lubricating property even though its antistatic property is good.

Attempts have been made to prepare a spinning lubricant by making the most of the satisfactory characteristics of each component but no sufficiently satisfactory spinning lubricant has yet been attained.

SUMMARY OF THE INVENTION

As a result of intensive studies to solve the problems described above, the inventors of the present invention have found that various spinning characteristics, such as openability, condensability, cohesiveness and the like, can be adjusted by the use of a compound having a specific structure and a good lubricating property among cationic and amphoteric surfactants having a high antistatic property as the lubricant component. The inventors have found that the lubricating property of wax, in particular, is excellent, and have completed the spinning lubricant having excellent spinning characteristics that is suitable for high-speed spinning.

Thus, the present invention provides a spinning lubricant for an acrylic fiber which contains the following components (a) and (b):

(a) at least one member selected from the group consisting of ester wax, paraffin wax, polyethylene wax and polyethylene oxide wax, each having a melting point of 30° to 130° C.; and (b) at least one of cationic surfactants and amphoteric surfactants represented by the following general formulas (1) to (5):

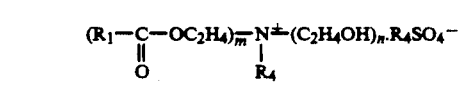

$$(R_1-\underset{\underset{O}{\|}}{C}-OC_2H_4)_m-\underset{\underset{R_4}{|}}{N^{\pm}}-(C_2H_4OH)_n.R_4SO_4^- \quad (1)$$

-continued

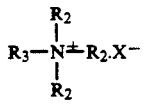

$$R_3-\overset{\overset{R_2}{|}}{\underset{\underset{R_2}{|}}{N^{\pm}}}-R_2.X^- \quad (2)$$

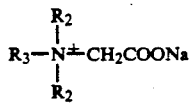

$$R_3-\overset{\overset{R_2}{|}}{\underset{\underset{R_2}{|}}{N^{\pm}}}-CH_2COONa \quad (3)$$

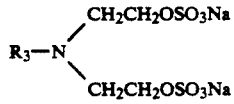

$$R_3-N\begin{matrix}CH_2CH_2OSO_3Na\\CH_2CH_2OSO_3Na\end{matrix} \quad (4)$$

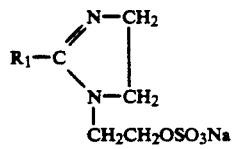

$$R_1-C\begin{matrix}N-CH_2\\N-CH_2\\|\\CH_2CH_2OSO_3Na\end{matrix} \quad (5)$$

where m and n represent numbers satisfying the relations of m:m=0.5 to 2.0 and m+n=3; $R_1$ represents a $C_7$ to $C_{21}$ straight-chain or branched alkyl or alkenyl group; $R_2$ represents independently a methyl group, an ethyl group, a hydroxyethyl group or a hydroxypropyl group; $R_3$ represents a $C_8$ to $C_{22}$ straight-chain or branched alkyl or alkenyl group; $R_4$ represents a methyl group or an ethyl group; and X represents a halogen ion, a $C_1$ to $C_9$ carboxylic or hydroxycarboxylic acid ion, a $C_1$ to $C_{22}$ alkyl phosphate ion or a $C_1$ to $C_4$ monoalkyl sulfate ion.

DETAILED DESCRIPTION OF THE INVENTION

The spinning lubricant composition for acrylic fiber, according to the invention, comprises (a) at least one wax having a melting point of 30 to 130 degree, selected from the group consisting of ester wax, paraffin wax, polyethylene wax and polyethylene oxide wax, and (b) at least one surfactant, being cationic or amphoteric, selected from the group consisting of surfactants having the above shown respective formulae (1) to (5).

It is preferable that the composition comprises, based on the solid matter, 10 to 80 wt. % of (a) and 3 to 50 wt. % of (b).

The composition may further comprise (c) an oxyalkylene polymer having the formula (6) and an average molecular weight of 2,000 to 40,000 and (d) at least one nonionic surfactant of polyoxyethylene type having the number of added ethylene oxide units of 4 to 20.

$$R^5-O-(R^6-O)_p-H \quad (6)$$

in which $R^5$ is hydrogen, an alkyl group having 1 to 20 carbon atoms, an alkenyl group having 1 to 20 carbon atoms, an acyl group having 2 to 22 carbon atoms, an aryl group, or a polyhydric alcohol, $R^6$ is an alkenyl group having 2 to 4 carbon atoms and p is a number to meet the above shown molecular weight range. It is preferred to comprise, based on the solid matter, 5 to 50 wt. % of (a), 3 to 50 wt. % of (b), 3 to 50 wt. % of (c) and 1 to 50 wt. % of (d).

The invention moreover provides an aqueous emulsion which comprises 1 to 10 wt. % of the lubricant composition as defined above and the balance being water, and a method for spinning acrylic fiber, which comprises the step of spinning the acrylic fiber with the spinning lubricant composition defined above. It is preferable that the acrylic fiber is yarn-dyed acrylic fiber.

Particular examples of the wax as the component (a) to be used in the present invention having a melting point of 30 to 130° C. include ester waxes such as stearylstearate, phthalic acid distearate, adipic acid distearate, sorbitan monostearate; paraffin waxes such as carnauba wax, Japan wax, ceramic wax, paraffin wax, montan wax, etc.; polyethylene wax such as polyethylene wax produced by the Ziegler process; and polyethylene oxide wax such as a partial oxidation product of polyethylene wax produced by the Ziegler process.

The wax is preferred to have a melting point of 30 to 100 degree centigrade from the viewpoint of smoothness and prevention of oil spots which occur in the dyeing step. It may be used together with another emulsifier to increase the emulsifying power. The yarn-dyed acrylic fiber is spun after dyeing, and this is the reason the composition of the invention is more effective. It may be used in a greater amount than usual.

The cationic or amphoteric surfactants as the component (b) to be used for the spinning lubricant for the acrylic fiber of the present invention are those compounds which are represented by the following general formulas (1) to (5):

$$(R_1-\underset{\underset{O}{\|}}{C}-OC_2H_4)_m\underset{\underset{R_4}{|}}{N^+}(C_2H_4OH)_n.R_4SO_4^- \quad (1)$$

where $R_1$ represents a $C_7$ to $C_{21}$ straight-chain or branched alkyl or alkenyl group.

The $R_1$—COO— group as the acyl group includes caprylic, capric, lauric, myristic, palmitic, stearic, oleic, and 2-octyldodecylic acid groups. $R_4$ represents a methyl or ethyl group.

Particular examples of the compounds represented by the general formula (1) include triethanolamine caprylate N-methylmethosulfates; triethanolamine caprate N-methylmethosulfates, triethanolamine laurate N-methylmethosulfates, triethanolamine myristate N-methylmethosulfates, triethanolamine palmitate N-methylmethosulfates, triethanolamine stearate N-methylmethosulfates, triethanolamine oleate N-methylmethosulfates, triethanolamine coconut acid or hardened coconut acid ester-N-methylmethosulfates, triethanolamine beef tallow or hardened beef tallow ester-N-metbylmethosulfates, and the like. The examples further include their ethosulfates, proposulfates and butosulfates.

The molar ratio of the carboxylic acid to triethanolamine, that is, m and n in the formula (1), are preferably within the range of m:n=0.5 to 2.0. If the molar ratio is smaller than 0.5, the lubricating property is low, while if it is greater than 2.0, the antistatic property becomes poor.

$$R_3-\underset{\underset{R_2}{|}}{\overset{\overset{R_2}{|}}{N^+}}-R_2.X^- \quad (2)$$

where $R_2$ represents independently a methyl group, an ethyl group, a hydroxyethyl group or a hydroxypropyl group, and $R_3$ represents a $C_8$ to $C_{22}$ straight-chain or branched alkyl or alkenyl group such as an octyl group, a decyl group, a dodecyl group, a palmityl group, a stearyl group, an oleyl group, and the like.

Examples of $X^-$ include a halogen ion such as chlorine ion, bromine ion, etc; ions of $C_1$ to $C_6$ carboxylic or hydroxycarboxylic acid such as formic, acetic, propionic, glycolic, butyric, malic, and succinic acids; ions of $C_1$ to $C_{22}$ alkyl phosphates such as methyl phosphate, ethyl phosphate, propyl phosphate, butyl phosphate, amyl phosphate, hexyl phosphate, octyl phosphate, decyl phosphate, dodecyl phosphate, myristyl phosphate, palmityl phosphate, stearyl phosphate, behenyl phosphate, oleyl phosphate, 2-ethylhexyl phosphate, 2-octyldodecyl phosphate, etc.; and $C_1$ to $C_4$ monoalkyl sulfate ions such as methyl sulfate ion, ethyl sulfate ion, butyl sulfate, and the like.

Particular examples of the compound represented by the general formula (2) includes octylamine-N,N,N-trimethyl methosulfate, decylamine-N,N,N-trimethyl methosulfate, laurylamine-N,N,N-trimethyl methosulfate, myristylamine-N,N,N-trimethyl sulfate, palmitylamine-N,N,N-trimethyl methosulfate, stearylamine-N,N,N-trimethyl methosulfate, coconut alkylamine-N,N,N-trimethyl methosulfate, beef tallow or hardened beef tallow alkylamine-N,N,N-trimethyl methosulfate, octylamine-N,N,N-trimethyl ethosulfate, decylamine-N,N,N-trimethyl ethosulfate, laurylamine-N,N-dimethyl-N-ethyl ethosulfate, myristylamine-N,N-dimethyl-N-ethyl ethosulfate, palmitylamine-N,N-dimethyl-N-ethyl ethosulfate, stearylamine-N,N-dimethyl-N-ethyl ethosulfate, coconut alkylamine-N,N-dimethyl-N-ethyl ethosulfate, beef tallow or hardened beef tallow alkylamine-N,N-dimethyl-N-ethyl ethosulfate, and their proposulfates and butosulfates.

The examples further include laurylamine-N,N-dimethyl-N-2-hydroxyethyl/glycolic acid salt, myristylamine-N,N-dimethyl-N-2-hydroxyethyl/glycolic acid salt, palmitylamine-N,N-dimethyl-N-2-hydroxyethyl/glycolic acid salt, stearylamine-N,N-dimethyl-N-2-hydroxyethyl/glycolic acid salt, coconut amine-N,N-dimethyl-N-2-hydroxyethyl/glycolic acid salt, hardened beef tallow amine-N,N-dimethyl-N-2-hydroxyethyl/glycolic acid salt, laurylamine-N,N-dimethyl-N-2-hydroxyethyl lauryl phosphate salt, myristylamine-N,N-dimethyl-N-2-hydroxyethyl lauryl phosphate salt, palmitylamine-N,N-dimethyl-N-2-hydroxyethyl lauryl phosphate salt, stearylamine-N,N-dimethyl-N-2-hydroxyethyl lauryl phosphate salt, coconut amine-N,N-dimethyl-N-2-hydroxyethyl lauryl phosphate salt, hardened bee tallow amine-N,N-dimethyl-N-2-hydroxyethyl lauryl phosphate salt, and the like.

$$R_3-\underset{\underset{R_2}{|}}{\overset{\overset{R_2}{|}}{N^+}}-CH_2COONa \quad (3)$$

where $R_2$ and $R_3$ are as defined above in the compounds represented by the general formula (2).

Particular examples of the compounds represented by the general formula (3) include 2-(N-decyl-N,N-dimethyl)aminoacetic acid sodium salt, 2-(N-lauryl-N,N-dimethyl)aminoacetic acid sodium salt, 2-(N-myristyl-N,N-dimethyl)aminoacetic acid sodium salt, 2-(N-palmityl-N,N-dimethyl)aminoacetic acid sodium salt, 2-(N-stearyl-N,N-dimethyl)aminoacetic acid sodium salt, 2-(N-behenyl-N,N-dimethyl)aminoacetic acid sodium salt, 2-(N-oleyl-N,N-dimethyl)aminoacetic acid sodium salt, 2-(N-2-ethylhexyl-N,N-dimethyl)aminoacetic acid sodium salt, 2-(N-2-octyldodecyl-N,N-dimethyl-)aminoacetic acid sodium salt, 2-(N-coconut alkyl-N,N-dimethyl)aminoacetic acid sodium salt, 2-(N-beef tallow alkyl-N,N-dimethyl)aminoacetic acid sodium salt, and the like.

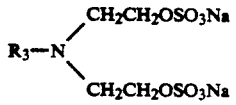

(4)

where $R_3$ is as defined above in the compounds represented by the general formula (2).

Particular examples of the compounds represented by the general formula (4) include N-decylamino-N,N-di(2-ethylsulfuric acid) sodium salt, N-laurylamino-N,N-di(2-ethylsulfuric acid) sodium salt, N-myristylamino-N,N-di(2-ethylsulfuric acid) sodium salt, N-palmitylamino-N,N-di(2-ethylsulfuric acid) sodium salt, N-stearylamino-N,N-di(2-ethylsulfuric acid) sodium salt, N-oleylamino-N,N-di(2-ethylsulfuric acid) sodium salt, N-behenylamino-N,N-di(2-ethylsulfuric acid) sodium salt, N-2-ethylhexylamino-N,N-di(2-ethylsulfuric acid) sodium salt, N-2-octyldodecylamino-N,N-di(2-ethylsulfuric acid) sodium salt, and the like.

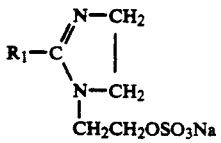

(5)

where $R_1$ represents a $C_7$ to $C_{21}$ straight-chain or branched alkyl or alkenyl group.

If the $R_1$—C group in the 2-(2-alkylimidazolyl)ethylsulfuric acid sodium salts represented by the general formula (5) is expressed as the carboxylic acid group, particular examples include caproic, caprylic, capric, lauric, myristic, palmitic, stearic, behenic, oleic, 2-ethylhexanoic, and 2-octyldodecylic acid groups.

Besides the components described above, it is possible to add to the spinning lubricant of the present invention a nonionic surfactant to improve the emulsion stability and handleability of the lubricant to such an extent as not to deteriorate the spinning properties. Examples of the nonionic surfactants used in this case include polyoxyethylene alkyl ether, polyoxyethylene nonylphenyl ether, ethylene oxide or propylene oxide modified silicon activator, and the like. The amount of the nonionic surfactant added for adjusting the form of the spinning lubricant is generally up to 60% and preferably, from 5 to 30%.

The component (a) is added to the spinning lubricant of the present invention in an amount of 10 to 80%, preferably 20 to 70%, based on the solid or active content. If the amount of the component (a) exceeds 80%, the condensability becomes insufficient and sliver and yarn breakage occurs frequently. The component (b) is blended in an amount of 3 to 50%, preferably 10 to 40% based on the solid content. If the amount of the component (b) is below 3%, the antistatic property drops and if it exceeds 50%, the condensability becomes excessively high.

The component (c) includes the following preferable embodiments. Particular examples of the $R_5$ group include methyl, ethyl, propyl, butyl, acyl, octyl, decyl, lauryl, myristyl, palmityl, stearyl, behenyl, 2-ethylhexyl, 2-octyldodecyl groups. Particular examples of the acyl group include acetyl group, caproic, caprylic, capric, lauric, myristic, palmitic, stearic, oleic acid groups. The aryl group includes nonylphenyl and octylphenyl groups. The polyhydric alcohol group includes glycerin, neopentyl glycol and trimethylolpropane. Particular examples of the epoxy compounds to use for oxyalkylation include ethylene oxide, propylene oxide, butylene oxide, and the like. Particular examples of the $R_6$ group include ethylene, isopropylene, butylene, isobutylene groups. The polymer (c) may be random polymers or block polymers, preferably having a molecular weight of 2,000 to 40,000, more preferably 6,000 to 40,000, determined according to gel chromatography in reference to a standard polystyrene having a given molecular weight, for example that of 10,000 on the weight average. The preferable range provides an adequate film strength.

The nonionic surfactant (d) includes the following preferable embodiments. The number of added ethylene oxide units is 4 to 20, preferably 6 to 15, from the viewpoint of the emulsifying property and collectivity. Particular examples include polyoxyethylene lauryl ether, polyoxyethylene myristyl ether, polyoxyethylene palmityl ether, polyoxyethylene stearyl ether, polyoxyethylene oleyl ether, polyoxyethylene octylphenyl ether, polyoxyethylene nonylphenyl ether, polyoxyethylene monolaurate, polyoxyethylene monostearate, and polyoxyethylene monoolate.

The composition may further comprise a sorbitan ester together with the component (d) to improve antiseptic property and feel.

The composition of the invention comprises essentially (a) and (b). Then the second embodiment includes (c). The third includes (d).

Preferable proportions of the lubricant are explained below. It comprises the component (a) in an amount of 5 to 50% , preferably 10 to 40%, from the viewpoint of collectivity to cause sliver and yarn breakage. The component (b) is blended in an amount of 3 to 50%, preferably 10 to 40%, from the viewpoint of the antistatic property and the collectivity. The component (c) is blended in an amount of 3 to 50%, preferably 10 to 40%, from the viewpoint of prevention of white powder and the collectivity. The component (d) is blended in an amount of 10 to 50%, preferably 10 to 40%, from the viewpoint of collectivity to cause openability of the fibers.

The amount of application of the spinning lubricant of the present invention may have a value over a wide range in accordance with the intended application but is generally from 0.2 to 2.0% and preferably from 0.3 to 1.5% in terms of the solid or active content based on the fiber.

The spinning lubricant of the present invention may be applied to the fiber by an ordinary method. For example, it may be applied in the form of an aqueous emulsion (generally in the lubricant concentration of 1 to 10%) at an arbitrary stage of the production or finishing processes of the acrylic fiber by a known oiling method such as a roller oiling method, an immersion oiling method, and the like. After the lubricant is supplied by the immersion oiling method, it is possible to heat-dry the treated fiber and then to apply the lubricant once again by the spray method. As for the application timing of the lubricant, it can be applied at various stages such as at the spinning step, the step immediately before the stretching step, at the stretching step, at the finishing step, and so forth.

The forms of the fiber to be treated may be various, such as filament yarns, tows, staples, unstretched yarns, and so forth.

As the component (a), those waxes which have a melting point of 30° to 100° C. have a particularly high lubricating property and are suitable for use in the spinning lubricant of the present invention. If the melting point is below 30° C., the wax has a low lubricating property and if it is above 100° C., the wax may cause problems such as the formation of oil spots in the dyeing step. If the emulsifying property of the wax is insufficient, problems in dyeing will occur. Accordingly, an emulsifier having a high emulsifying property is preferably used in combination.

As the fibers to be treated by the lubricant of the present invention, yarn-dyed acrylic fibers are particularly preferable because they can be freed from the problems described above, and the spinning lubricant of the present invention can be used while stressing its characteristics by increasing the amount of its application.

The spinnability can be determined from the viewpoint of winding on rollers, the deposit of white powder, the amount of fly, and the breaking of yarn and fiber. The use of an oxyalkylene polymer provides an improvement in the reduction of the deposit, of white powder in the open end and decrease of winding on rollers. The use of a nonionic surfactant of polyoxyethylene type can adjust collectivity.

The lubricant of the present invention reduces the friction with metals but gives suitable friction between the yarns. Accordingly, the condensability of the fibers is suitable, and good spinnability can be obtained even when used in a high-speed spinning process.

EXAMPLES

Now the present invention will be described with reference to Examples thereof, though it is not limited to these Examples.

The term "%" represents the percentage by weight.

EXAMPLE 1

Each spinning lubricant listed in Table 1 was immersed and supplied by the spray method in the form of an aqueous emulsion (0.5%) to acrylic fiber staples (1.7 d, 38 mm) and dried at 60° C. for 2 hours.

After the staples thus treated were tempered for a whole day and night, a spinning test was conducted by the use of a spinning tester manufactured by Platt. More specifically the quantity of electricity generated in the carding step (antistatic property), passage through card (winding on cylinder), condensability of slivers (lap form) and roller winding in the drawing step were measured. Spinnability was also tested by a ring and open-end spinning mill. The spinning conditions included a temperature of 25° C. and a humidity of 50%.

The results are given in Table 2.

RESULTS

The products of this invention Nos. 5 to 7 and 10 to 14 have good spinnability for both ring and open-end spinning mills. They have particularly high spinnability for the open-end spinning mill. This is because of the sliver strength which is in a suitable range (80 to 90 g). This is believed to result from the fact that openability and condensability of the sliver are in suitable ranges for this process.

On the other hand, the Comparative Products Nos. 8 and 9 using a quaternary benzylammonium salt as the cation have excessively great sliver strength, so that the openability is poor and so is the spinnability.

As to the antistatic property, all the products except for the Comparative Products Nos. 2 and 4 using a sesquistearate are substantially good.

EXAMPLE 2

Each spinning lubricant listed in Table 3 was prepared by use of an amphoteric surfactant, and fiber treatment was carried out in the same way as that in Example 1. The same evaluation was made with the result shown in Table 4.

RESULTS

The products of this invention Nos. 15 to 17 and 20 to 24 have good spinnability for both ring and open-end spinning mills Particularly, they are excellent for the open-end type. This is because of the sliver strength which is in a suitable range (80 to 90 g). This is believed to result from the fact that openability and condensability of the slivers are controlled to be in a suitable range of this process.

On the other hand, the Comparative Products Nos. 18 and 19 using 2-(benzyl-N,N-dimethyl)aminoacetic acid sodium salt as the amphoteric surfactant have poor openability because the sliver strength is too large, and their spinnability is also inferior.

TABLE 1

| | Lubricant No. | | | | | | | | | | | | | |
|---|---|---|---|---|---|---|---|---|---|---|---|---|---|---|
| | Comparative product | | | | Product of this invention | | | Comparative product | | Product of this invention | | | | |
| Component | 1 | 2 | 3 | 4 | 5 | 6 | 7 | 8 | 9 | 10 | 11 | 12 | 13 | 14 |
| sesquilauryl phosphate K salt | 80 | | 80 | | | | | | | | | | | |
| sesquistearyl phosphate K salt | | 80 | | 80 | | | | | | | | | | |
| paraffin wax (m.p.: 57.2° C.) | | | | | 20 | | 20 | | 20 | 20 | | 20 | 20 | |
| polyethylene wax | | | | | | 20 | | 20 | | | 20 | | | 20 |
| cationic surfactant (1)*1 | | | | | 60 | | | | | 60 | | | 30 | |
| cationic surfactant (2)*2 | | | | | | 60 | | | | | 60 | | 30 | 30 |
| cationic surfactant (3)*3 | | | | | | | 60 | | | | | 60 | | 30 |
| cationic surfactant (4)*4 | | | | | | | | 60 | 60 | | | | | |
| $(POE)_8$ lauryl ether | 20 | 20 | | | 20 | 20 | 20 | 20 | | | | | 20 | |

TABLE 1-continued

| Component | Lubricant No. 1 (Comparative product) | 2 | 3 | 4 | 5 (Product of this invention) | 6 | 7 | 8 (Comparative product) | 9 | 10 (Product of this invention) | 11 | 12 | 13 | 14 |
|---|---|---|---|---|---|---|---|---|---|---|---|---|---|---|
| $(POE)_9$ nonylphenyl ether | | | 20 | 20 | | | | | 20 | 20 | 20 | 20 | | 20 |

Note:
*1cationic surfactant (1) triethanolamine sesqui (beef tallow acid ester)-N-methylmethosulfate
*2cationic surfactant (2) beef tallow alkylaminetrimethyl methosulfate
*3cationic surfactant (3) distearylamine-N,N-dimethyl chloride
*4cationic surfactant (4) N-benzyl-N,N,N-trimethylammonium chloride

TABLE 2

| | Lubricant No. | Hand | Anti-static property | Sliver strength (g) | Draw winding | Spinnability open-end | Spinnability ring |
|---|---|---|---|---|---|---|---|
| Comparative product | 1 | x | ◎ | 120 | 5 | x | x |
| | 2 | x | x | 100 | 2 | Δ | Δ |
| | 3 | Δ | ◎ | 120 | 5 | x | x |
| | 4 | Δ | x | 100 | 2 | Δ | Δ |
| Product of this invention | 5 | ◎ | ◎ | 80 | 0 | ◎ | ◎ |
| | 6 | ○ | ◎ | 85 | 0 | ◎ | ◎ |
| | 7 | ○ | ◎ | 90 | 0 | ◎ | ◎ |
| Comparative product | 8 | x | ◎ | 140 | 1 | x | Δ |
| | 9 | x | ◎ | 120 | 2 | x | Δ |
| Product of this invention | 10 | ◎ | ◎ | 80 | 0 | ◎ | ◎ |
| | 11 | ○ | ◎ | 87 | 0 | ◎ | ◎ |
| | 12 | ○ | ◎ | 90 | 0 | ○ | ○ |
| | 13 | ◎ | ◎ | 87 | 0 | ◎ | ◎ |
| | 14 | ◎ | ◎ | 83 | 0 | ◎ | ◎ |

Evaluation marks:
◎ ○ Δ x
good ⇄ poor

TABLE 3

| Component | Lubricant No. 1 (Comparative product) | 2 | 3 | 4 | 15 (Product of this invention) | 16 | 17 | 18 (Comparative product) | 19 | 20 (Product of this invention) | 21 | 22 | 23 | 24 |
|---|---|---|---|---|---|---|---|---|---|---|---|---|---|---|
| sesquilauryl phosphate K salt | 80 | | 80 | | | | | | | | | | | |
| sesquistearyl phosphate K salt | | 80 | | 80 | | | | | | | | | | |
| paraffin wax (m.p.: 57.2° C.) | | | | | 20 | | 20 | | 20 | 20 | | 20 | 20 | |
| polyethylene wax | | | | | | 20 | | 20 | | | 20 | | | 20 |
| amphoteric surfactant (1)*1 | | | | | 60 | | | | | 60 | | | 30 | |
| amphoteric surfactant (2)*2 | | | | | | 60 | | | | | 60 | | 30 | 30 |
| amphoteric surfactant (3)*3 | | | | | | | 60 | | | | | 60 | | 30 |
| amphoteric surfactant (4)*4 | | | | | | | | 60 | 60 | | | | | |
| $(POE)_8$ lauryl ether | 20 | 20 | | | 20 | 20 | 20 | 20 | | | | | 20 | |
| $(POE)_9$ nonylphenyl ether | | | 20 | 20 | | | | | 20 | 20 | 20 | 20 | | 20 |

Note:
*1amphoteric surfactant (1): 2-(N-lauryl-N,N-dimethyl)aminoacetic acid sodium salt
*2amphoteric surfactant (2): N-oleylamino-N,N-di(ethylsulfuric acid) sodium salt
*3amphoteric surfactant (3): 2-(laurylimidazole)ethylsulfuric acid sodium salt
*4amphoteric surfactant (4): 2-(benzyl-N,N-dimethyl)aminoacetic acid sodium salt

TABLE 4

| | Lubricant No. | Hand | Anti-static property | sliver strength (g) | Draw winding | Spinnability open-end | Spinnability ring |
|---|---|---|---|---|---|---|---|
| Comparative product | 1 | x | ◎ | 120 | 5 | x | x |
| | 2 | x | x | 100 | 2 | Δ | Δ |
| | 3 | Δ | ◎ | 120 | 5 | x | x |
| | 4 | Δ | x | 100 | 2 | Δ | Δ |
| Product of this invention | 15 | ◎ | ◎ | 78 | 0 | ◎ | ◎ |
| | 16 | ○ | ◎ | 82 | 0 | ◎ | ◎ |
| | 17 | ○ | ◎ | 88 | 1 | ○ | ◎ |
| Comparative product | 18 | x | ◎ | 150 | 5 | x | x |
| | 19 | x | ◎ | 162 | 5 | x | x |
| Product of this invention | 20 | ○ | ◎ | 82 | 0 | ◎ | ◎ |

TABLE 4-continued

| | Lubricant No. | Hand | Anti-static property | sliver strength (g) | Draw winding | Spinnability open-end | Spinnability ring |
|---|---|---|---|---|---|---|---|
| this invention | 21 | ◎ | ◎ | 91 | 1 | ○ | ○ |
| | 22 | ○ | ◎ | 93 | 1 | ◎ | ◎ |
| | 23 | ◎ | ◎ | 80 | 0 | ◎ | ○ |
| | 24 | ◎ | ◎ | 78 | 0 | ◎ | ◎ |

Evaluation marks:
◎ ○ Δ x
good ⇄ poor

EXAMPLE 3

Example 1 was followed. The compounds used are shown below.

| | | |
|---|---|---|
| wax | A | paraffin wax (135 degree F.) |
| | B | polyethylene wax |
| cationic surfactant | A | trimethanolamine sesqui beef tallow acid ester N methyl methosulfate |
| | B | beef tallow alkylamine NNN trimethyl methosulfate |
| | C | coconut alkyl NN bispolyoxyethylene N methyl methosulfate |
| | D | N benzyl NNN trimethyl ammonium methosulfate |
| amphoteric surfactant | K | sodium 2(N lauryl NN dimethyl) sulfate |
| | L | sodium N oleyl NN di(ethylsulfate) |
| | M | sodium 2(laurylimidazolyl)ethylsulfate |
| | N | sodium 2(benzyl NN dimethylamine)acetate |
| POA polymer | A | polyethyleneglycol (mw 6000) |
| POA polymer | B | random polymer of ethylene oxide and propylene oxide (mw 6000) |
| POA polymer | C | block polymer of ethylene oxide and propylene oxide (mw 6000) |
| nonionic | A | polyoxyethylene (8) lauryl ether |

-continued

| | | |
|---|---|---|
| surfactant | B | polyoxyethylene (8) nonylphenyl ether |

The antistatic property was determined at 40% RH at 30 degree centigrade. In results, a double circle shows the best in which lower than 100 volts are detected at the position of the card. The winding on roller in the drawing step was determined at 25 degree centigrade at 85% RH. In results, a circle shows good in which not more than 5 times are found for 20 minutes. Results of the open end are shown by the following marks:

| marks | | rotation rate of the rotor | times of breaking of fiber |
|---|---|---|---|
| best | ◎ | 60,000 rpm | not more than 10 |
| good | ○ | 60,000 rpm | not less than 10 |
| | | 40,000 rpm | not more than 5 |
| bad | x | 40,000 rpm | not less than 20 |

Results are shown in Tables 5 to 8. The compositions 1 to 30 fall within the scope of the invention and the compositions 31 to 46 fall outside the invention. It is found that the invention is improved in open end and ring, in particular open end. This improvement is caused by the good collectivity or condensability and openability of the sliver, showing a practically suitable range of 80 to 90 grams. Especially the compositions 31 to 39 using cationic and amphoteric surfactants had excess collectivity or condensability and a bad openability. The invention is improved also in the antistatic property at card and roller winding. The compositions 40 to 46 using wax and a cationic or amphoteric surfactant are found to cause a little more breaking than the invention, 10 to 50 times.

The above shows that the invention provides acrylic fiber with a good spinnability, by using wax having a low dynamic friction coefficient and a cationic or amphoteric surfactant having a good antistatic property.

TABLE 5

| | | (the invention) | | | | | | | | | | | | | | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 |
| composition | | | | | | | | | | | | | | | | |
| wax | A | 30 | 30 | 30 | 30 | 30 | 30 | | | 30 | 30 | | 30 | 30 | | |
| | B | | | | | | | 30 | 30 | | | 30 | | | 30 | 30 |
| cationic | A | 30 | | | | | | 30 | | | | | | | | |
| surfactant | B | | 30 | | | | | | | 30 | | | 30 | | | |
| | C | | | 30 | | | | | | | | | | | 30 | |
| amphoteric | K | | | | 30 | | | | 30 | | | 30 | | 30 | | |
| surfactant | L | | | | | 30 | | | | | 30 | | | | | |
| | M | | | | | | 30 | | | | | | | | | 30 |
| POA polymer | A | 40 | 40 | 40 | 40 | 40 | 40 | 40 | 40 | | | | | | | |
| | B | | | | | | | | | 40 | 40 | 40 | | | | |
| | C | | | | | | | | | | | | 40 | 40 | 40 | 40 |
| test | | | | | | | | | | | | | | | | |
| antistatic | | ◎ | ◎ | ◎ | ◎ | ◎ | ◎ | ◎ | ◎ | ◎ | ◎ | ◎ | ◎ | ◎ | ◎ | ◎ |
| sliver | | 83 | 87 | 81 | 82 | 81 | 89 | 89 | 86 | 83 | 89 | 89 | 84 | 85 | 82 | 86 |
| winding | | ○ | ○ | ○ | ○ | ○ | ○ | ○ | ○ | ○ | ○ | ○ | ○ | ○ | ○ | ○ |
| open end | | ◎ | ◎ | ◎ | ◎ | ◎ | ◎ | ◎ | ◎ | ◎ | ◎ | ◎ | ◎ | ◎ | ◎ | ◎ |
| ring | | ◎ | ◎ | ◎ | ◎ | ◎ | ◎ | ◎ | ◎ | ◎ | ◎ | ◎ | ◎ | ◎ | ◎ | ◎ |

TABLE 6

| | | (the invention) | | | | | | | | | | | | | | |
|---|---|---|---|---|---|---|---|---|---|---|---|---|---|---|---|---|
| | | 16 | 17 | 18 | 19 | 20 | 21 | 22 | 23 | 24 | 25 | 26 | 27 | 28 | 29 | 30 |
| composition | | | | | | | | | | | | | | | | |
| wax | A | 30 | 30 | 30 | 30 | 30 | 30 | | | 30 | 30 | | 30 | 30 | | |
| | B | | | | | | | 30 | 30 | | | 30 | | | 30 | 30 |
| cationic | A | 20 | | | | | | 20 | | | | | | | | |
| surfactant | B | | 20 | | | | | | | 20 | | | 20 | | | |
| | C | | | 20 | | | | | | | | | | | 20 | |
| amphoteric | K | | | | 20 | | | | 20 | | | 20 | | 20 | | |
| surfactant | L | | | | | 20 | | | | | 20 | | | | | |
| | M | | | | | | 20 | | | | | | | | | 20 |
| POA polymer | A | 30 | 30 | 30 | 30 | 30 | 30 | 30 | 30 | | | | | | | |
| | B | | | | | | | | | 30 | 30 | 30 | | | | |
| | C | | | | | | | | | | | | 30 | 30 | 30 | 30 |
| nonionic | A | 20 | | 20 | | 20 | | 20 | | | 20 | | | | 20 | |
| surfactant | B | | 20 | | 20 | | 20 | | 20 | 20 | | 20 | 20 | 20 | | 20 |
| test | | | | | | | | | | | | | | | | |
| antistatic | | ◎ | ◎ | ◎ | ◎ | ◎ | ◎ | ◎ | ◎ | ◎ | ◎ | ◎ | ◎ | ◎ | ◎ | ◎ |
| sliver | | 83 | 83 | 81 | 83 | 84 | 86 | 83 | 86 | 86 | 84 | 89 | 86 | 82 | 90 | 89 |
| winding | | ○ | ○ | ○ | ○ | ○ | ○ | ○ | ○ | ○ | ○ | ○ | ○ | ○ | ○ | ○ |
| open end | | ◎ | ◎ | ◎ | ◎ | ◎ | ◎ | ◎ | ◎ | ◎ | ◎ | ◎ | ◎ | ◎ | ◎ | ◎ |
| ring | | ◎ | ◎ | ◎ | ◎ | ◎ | ◎ | ◎ | ◎ | ◎ | ◎ | ◎ | ◎ | ◎ | ◎ | ◎ |

TABLE 7

| | | (comparison) | | | | | | | | |
|---|---|---|---|---|---|---|---|---|---|---|
| | | 31 | 32 | 33 | 34 | 35 | 36 | 37 | 38 | 39 |
| composition | | | | | | | | | | |
| wax | A | 30 | 30 | 30 | 30 | 30 | 30 | | | |
| | B | | | | | | | 30 | 30 | 30 |
| cationic | D | 30 | 30 | 30 | 20 | | | | | |
| amphoteric | N | | | | | 20 | 20 | 20 | 20 | 20 |
| POA polymer | A | 40 | | | 30 | | | 30 | | |
| | B | | 40 | | | 30 | | | 30 | |
| | C | | | 40 | | | 30 | | | 30 |
| nonionic | A | | | | 20 | | 20 | | 20 | |
| surfactant | B | | | | | 20 | | 20 | | 20 |

TABLE 7-continued

| | (comparison) | | | | | | | | |
|---|---|---|---|---|---|---|---|---|---|
| | 31 | 32 | 33 | 34 | 35 | 36 | 37 | 38 | 39 |
| test | | | | | | | | | |
| antistatic | ◎ | ◎ | ◎ | ◎ | ◎ | ◎ | ◎ | ◎ | ◎ |
| sliver | 99 | 97 | 101 | 97 | 96 | 105 | 97 | 98 | 100 |
| winding | ○ | ○ | ○ | ○ | ○ | ○ | ○ | ○ | ○ |
| open end | X | X | X | X | X | X | X | X | X |
| ring | Δ | Δ | Δ | Δ | Δ | Δ | Δ | Δ | Δ |

TABLE 8

| | | (comparison) | | | | | | |
|---|---|---|---|---|---|---|---|---|
| | | 40 | 41 | 42 | 43 | 44 | 45 | 46 |
| composition | | | | | | | | |
| wax | A | 50 | 50 | 50 | 50 | | | |
| | B | | | | | 50 | 50 | 50 |
| cationic | A | 50 | | | | | | |
| surfactant | B | | | | | 50 | | |
| | C | | 50 | | | | 50 | |
| amphoteric | K | | | 50 | | | | |
| surfactant | L | | | | | | | 50 |
| | M | | | | 50 | | | |
| test | | | | | | | | |
| antistatic | | ◎ | ◎ | ◎ | ◎ | ◎ | ◎ | ◎ |
| sliver | | 84 | 87 | 89 | 90 | 80 | 88 | 83 |
| winding | | ○ | ○ | ○ | ○ | ○ | ○ | ○ |
| open end | | Δ | Δ | Δ | Δ | Δ | Δ | Δ |
| ring | | Δ | Δ | Δ | Δ | Δ | Δ | Δ |

We claim:

1. A spinning lubricant composition for an acrylic fiber, which comprises:

(a) at least one wax having a melting point of 30° to 130° C. selected from the group consisting of ester wax, paraffin wax, polyethylene wax and polyethylene oxide wax, and (b) at least one surfactant, being cationic or amphoteric, selected from the group consisting of surfactants having the respective formulae (1) to (5):

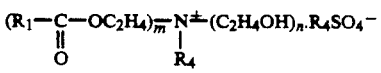

(1)

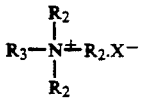

(2)

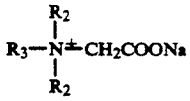

(3)

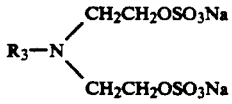

(4)

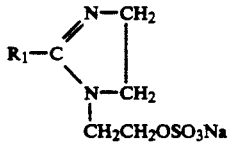

(5)

where m and n represent numbers satisfying the relations of m/n=0.5 to 2.0 and m+n=3; $R_1$ represents a $C_7$ to $C_{21}$ straight-chain or branched alkyl or alkenyl group; $R_2$ represents independently a methyl group, an ethyl group, a hydroxyethyl group or a hydroxypropyl group; $R_3$ represents a $C_8$ to $C_{22}$ straight-chain or branched alkyl or alkenyl group; $R_4$ represents a methyl group or an ethyl group; and X represents a halogen ion, a $C_1$ to $C_9$ carboxylic or hydroxycarboxylic acid ion, a $C_1$ to $C_{22}$ alkyl phosphate ion or a $C_1$ to $C_4$ monoalkyl sulfate ion; wherein the composition contains 10 to 80 weight % of component (a) and 3 to 50 weight % of component (b), based on the total solids content.

2. The composition as claimed in claim 1, which further comprises: (c) an oxalkylene polymer having the formula (6)

$$R^5—O—(R^6—O)_p—H \quad (6)$$

wherein $R^5$ is hydrogen, an alkyl group having 1 to 20 carbon atoms, an alkenyl group having 1 to 20 carbon atoms, an acyl group having 2 to 22 carbon atoms, an aryl group, or a polyhydric alcohol group selected from the group consisting of glyceryl, neopentyl glycolyl, and trimethylolpropyl, $R^6$ is an alkenyl group having 2 to 4 carbon atoms, and p is a number such that the average molecular weight of component (c) is 2,000 to 40,000; and (d) a polyoxyethylene non-ionic surfactant having 4 to 20 ethylene oxide units.

3. The composition as claimed in claim 2, which comprises, based on the solid matter, 5 to 50 wt. % of (a), 3 to 50 wt. % of (b), 3 to 50 wt. % of (c) and 1 to 50 wt. % of (d).

4. An aqueous emulsion which comprises 1 to 10 wt. % of the lubricant composition as defined in claim 1 or 2 and the balance of water.

5. A method for spinning acrylic fiber, which comprises applying the spinning lubricant composition of claim 1 or claim 2 to an acrylic fiber, and spinning said acrylic fiber with said spinning lubricant composition.

6. The method as claimed in claim 5, in which the acrylic fiber is yarn-dyed acrylic fiber.

7. The composition according to claim 2, wherein said nonionic surfactant (d) is selected from the group consisting of polyoxyethylene lauryl ether, polyoxyethylene myristyl ether, polyoxyethylene palmityl ether, polyoxyethylene stearyl ether, polyoxyethylene oleil ether, polyoxyethylene octylphenyl ether, polyoxyethylene nonylphenyl ether, polyoxyethylene monolaurate, polyoxyethylene monostearate, and polyoxyethylene monoolate.

8. A spinning lubricant composition for an acrylic fiber, which comprises:

(a) at least one wax having a melting point of 30° to 130° C., selected from the group consisting of ester wax, paraffin wax, polyethylene wax and polyethylene oxide wax, (b) at least one surfactant, being cationic or amphoteric, selected from the group consisting of surfactants having the respective formulae (1) to (5):

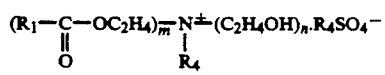

(1)

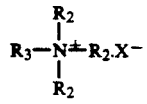

(2)

-continued

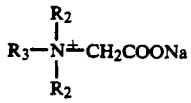

(3)

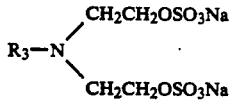

(4)

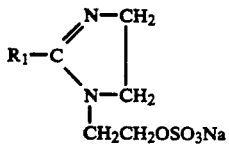

(5)

where m and n represent numbers satisfying the relations of $m/n=0.5$ to 2.0 and $m+n=3$; $R_1$ represents a $C_7$ to $C_{21}$ straight-chain or branched alkyl or alkenyl group; $R_2$ represents independently a methyl group, an ethyl group, a hydroxyethyl group or a hydroxypropyl group; $R_3$ represents a $C_8$ to $C_{22}$ straight-chain or branched alkyl or alkenyl group; $R_4$ represents a methyl group or an ethyl group; and X represents a halogen ion, a $C_1$ to $C_9$ carboxylic or hydroxycarboxylic acid ion, a $C_1$ to $C_{22}$ alkyl phosphate ion or a $C_1$ to $C_4$ monoalkyl sulfate ion; and (c) an oxalkylene polymer having the formula (6)

$$R^5—O—(R^6—O)_p—H \quad (6)$$

wherein $R^5$ is hydrogen, an alkyl group having 1 to 20 carbon atoms, an alkenyl group having 1 to 20 carbon atoms, an acyl group having 2 to 22 carbon atoms, an aryl group, or a polyhydric alcohol group selected from the group consisting of glyceryl, neopentyl glycolyl, and trimethylolpropyl, $R^6$ is an alkenyl group having 2 to 4 carbon atoms, and p is a number such that the average molecular weight of component (c) is 2,000 to 40,000.

* * * * *